United States Patent [19]

Weber et al.

[11] Patent Number: 4,547,061

[45] Date of Patent: Oct. 15, 1985

[54] ELECTROPHOTOGRAPHIC IMAGING APPARATUS AND METHOD PARTICULARLY FOR COLOR PROOFING

[75] Inventors: Harold J. Weber, Middlesex, Mass.; Manfred R. Kuehnle, Merrimac, N.H.; James C. Compton, Middlesex, Mass.; John N. Poulakis, Middlesex, Mass.; Michael J. Szymanski, Middlesex, Mass.; Kenneth A. Lindblom, Worcester, Mass.; Donald S. Cleveland, Essex, Mass.

[73] Assignee: Coulter Systems Corporation, Bedford, Mass.

[21] Appl. No.: 348,769

[22] Filed: Feb. 16, 1982

[51] Int. Cl.[4] ..... G03G 13/10; G03G 15/10

[52] U.S. Cl. ..... 355/10; 355/3 R; 355/12; 355/77

[58] Field of Search ..... 355/3 R, 4, 12, 77, 355/10

[56] References Cited

U.S. PATENT DOCUMENTS

| | | | |
|---|---|---|---|
| 3,040,621 | 6/1962 | Crumrine | 355/3 R |
| 3,694,069 | 9/1972 | Yamaji et al. | 355/4 |
| 4,010,288 | 3/1977 | Souma | 355/10 X |
| 4,149,798 | 4/1979 | McGowan et al. | 355/3 R X |
| 4,266,869 | 5/1981 | Kuehnle et al. | 355/77 X |
| 4,338,018 | 7/1982 | Kuehnle et al. | 355/77 X |
| 4,350,437 | 9/1982 | Fishburn | 355/77 X |
| 4,358,195 | 11/1982 | Kuehnle et al. | 355/77 X |
| 4,361,112 | 11/1982 | DiNallo et al. | 118/661 |
| 4,398,497 | 8/1983 | Matkan | 118/661 |
| 4,410,260 | 10/1983 | Kuehnle | 355/10 |
| 4,456,367 | 6/1984 | Szymanski et al. | 355/10 |

*Primary Examiner*—Fred L. Braun

*Attorney, Agent, or Firm*—Silverman, Cass & Singer, Ltd.

[57] ABSTRACT

Electrophotographic imaging apparatus, particularly for color proofing, is provided for normal daylight operation including a light-tight housing having a framework mounting plural spaced functional processing stations for charging, imaging, toning, transfer and, optionally, cleaning, all interior of the housing. A platen assembly mounting an electrophotographic member is translated along a linear path, the assembly being guided by a rail and a track secured along the entire length of the framework. A copyboard is disposed below the carriage within the imaging station and carries a transparency. The electrophotographic member is translated past the charging station for charging same and brought to the imaging station where the copyboard is raised, to establish an intimate engagement with the member established and exposed to an interior disposed radiant energy source. After exposure, the copyboard is lowered and the member translated to the toning station where one of plural available toning modules has been raised to intercept the platen whereby to establish a toning gap for toning with liquid toner carried by said one module during passage past said module. The member next is translated to the transfer station for transfer to a pre-wet sheet of transfer medium. A registration system is provided at both imaging and transfer stations to assure registration between the member and the transparency on the one hand and the member and the transfer medium on the other hand at the respective station whereby all functional tolerance relationships being maintained independent of the framework.

44 Claims, 11 Drawing Figures

1.
2.
3.
4.
5.
6.
7.
8.
9.

26
28
30
24
42
54
46
38
40
34
60
32
68
86
80
81

ELECTROPHOTOGRAPHIC IMAGING APPARATUS AND METHOD PARTICULARLY FOR COLOR PROOFING

BACKGROUND OF THE INVENTION

This invention relates generally to electrophotographic imaging and more particularly provides an improved method and apparatus for producing color proofs from color separated transparencies electrophotographically. Color proofs are needed to show the printing craftsman the results of color separation and whether the corrected separations are suitable for plate making. Of considerable importance is the simulation or prediction of the appearance of the final printed copy on the particular medium used for the final print-run. Proofs are especially needed at two stages in the printing process and are divided into two primary groups, separation proofs and pre-press proofs.

Separation proofs are made directly of the photoreproduction apparatus to determine the results of the separation process and the identity and character of any corrections needed. Of considerable importance is the capability of accurate and reproducible evaluation of factors such as color balance, tone reproduction, shadow detail, image sharpness, and contrast, among others. Economy and speed in making such proofs are sought after goals in color proofing. Equally important are reliability, reproducibility and predictability. The proof must reproduce the color separation film exactly without distortion or loss. Exact replicas of the printing ink characteristics should be reproduced so that overprinting colors will be the same on the proofs as they are with printing inks employed on the printed sheet.

The pre-press proof is intended to reproduce the result which will be obtained using the printing press, indicating the effects of the paper surface, ink strength, gloss, etc. The pre-press proof should show the same printing characteristics as the finished printed result.

The paper surface has an important effect on the appearance of the finished print and, in particular, the critical characteristics of said surface which affect the resultant print are color, ink absorbency and gloss. Color proofs can be made which simulate the effects of paper color. The effects of ink absorbency and gloss are complex and difficult to duplicate. Prints on newsprint lack contrast, are muddy in the middle tones and the inks applied thereto are dull. Prints on uncoated papers have improved contrast compared to prints on newsprint but the inks are still dull with middle tones dark and shadows lacking detail. Coated papers also result in different contrast, gloss, tone characteristics, etc. Thus a proof should be made on the actual paper which is to constitute the substrate carrying the finished printed image.

Ink strength is another important property of the print related to the printing medium as is gloss.

Thus, a press-proof, in order to be a valuable tool in color printing, should be made on the same paper upon which the actual printing is to be performed.

Several photomechanical processes for prepress-proofing are available. These systems fall into two categories, namely overlay systems and superimposition systems.

Overlay systems consist of a set of transparent light sensitive films which are dried or pigmented to simulate the four process colors, yellow, cyan, black and magenta. Each screened separation is exposed to the appropriate film and developed chemically. After development, four separate images are produced which are superimposed in register. The result is viewed as a transparency. These are generally employed where a quick and inexpensive proof is required and normally are not a satisfactory match for the printed reproduction. The whites are gray and the result, very glossy, suffering from internal reflections between film layers which generally cause color changes in overprinted colors. They are economical to produce, require no special equipment and are extensively used for internal checking.

Superimposition systems involve the production of an image on an integral backing sheet either specific to the process or of the type on which the final print will be made. These processes include the Cromalin process of DuPont Co., the Transfer Key process of Minnesota Mining and Manufacturing Corporation, the Gevaproof process of Agfa-Gevaert and the Remak process of Chemical Corporation of Australia, Pty. Ltd.

The Cromalin process involves the lamination of a tacky transparent photopolymer film to a base sheet under heat and pressure.

The film is hardened by exposure to ultraviolet light. The protective cover sheet is removed and toning powder of the appropriate color is dusted over the surface. The toner adheres only to the areas where no exposure has been received and the polymer remains tacky. The proof is produced by repeating this procedure four times, once for each separation. The base material is a heavy cast coated paper or a boardlike member, thus requiring specially made stock.

The Transfer Key process can employ any base stock. A set of four transparent light sensitive films are supplied which have been pigmented to simulate the four process colors. These films are coated with a pressure sensitive adhesive and may be adhered to a base stock to form the laminate. The exposed image is polymerized by exposure to ultraviolet light. The unhardened areas are removed by a solvent with the proof being built up one layer at a time. This process can be improved by producing the layers on a transparent base which in turn is laminated to a base sheet using a spacer to simulate dot gain.

The Gevaproof process also uses laminations to a base stock similar to the Transfer Key process.

The REMAK process is an electrostatic process wherein a sheet of paper coated with a zinc oxide/resin binder composition is charged electrostatically and exposed to light through a color separated transparency. The exposed sheet is immersed in a liquid toner bath and electrophoretically toned. The resulting visible image is transferred to any base stock or, alternatively, the proof may be built up by successive exposures and toning on the original base material. Unfortunately, the zinc oxide photoconductor used with the REMAK process is extremely sensitive to changes in temperature and relative humidity, as well as variations in toner lots.

Many of the problems of prior art proofing methods have been solved by the referenced application Ser. No. 139,459 filed Apr. 11, 1980, now U.S. Pat. No. 4,358,195. The referenced application discloses a method and apparatus which takes advantage of the high speed response of Kuehnle electrophotographic member using a flat-bed machine having plural stations sequentially arranged linearly along a framework. A color separated transparency was mounted on a copyboard and presented to a charged electrophotographic member and the transparency were superposed and exposed to a light source. The carrier for the electrophotographic member was manipulated (pivotally inverted) and presented to a movable toning station. The toned member was again inverted for presentation to a transfer means effective to transfer the toned image to a sheet of print stock. The process could be repeated with different separations and toners with registration being obtained by positioning both color separation and electrophotographic medium with registration means provided.

The method and apparatus of this invention provide many advantages which constitute improvement over the state of the art in respect of producing color proofs, including four-color proofs, comparison proofs and pre-press proofs, and particularly over the method and apparatus of the referenced application. For example, once the original color separation transparency is mounted, neither the imaging member or any other process related member need be touched or manipulated so that the sequence of processing steps is capable of proceeding serially automatically with a minimization of manually operated steps.

The invention enables normal daylight operation, enables improvements in control and fine adjustment of background density and/or fog, provides on-line cleaning, including discharge of any residual charge of the electrophotographic member subsequent to transfer and additionally reduces fabrication cost by substantially eliminating high precision components.

Additionally, with the invention, color proofs can be provided faster upon the actual printing material to be used by the printer so that the operator can view the proof result upon the same paper stock upon which the printing is to be performed.

SUMMARY OF THE INVENTION

Method and apparatus for producing a print copy of a graphic art image from a transparency carrying said image wherein a carriage, carrying a platen on which an electrophotographic member having a photoconductive surface facing outward, is translated along a linear path past plural functional stations including a charging station, an imaging or exposure station, a toning station, an image transfer station and a cleaning station sequentially, the path being defined in a single horizontal plane by guide means mounted on a framework within a housing. A copyboard is located within said housing at the imaging station and means are provided for mounting a selected transparency thereupon. A toning module is located within the housing, said toning module including a sump containing liquid toner, a generally planar development electrode and means for flowing liquid toner generally uniformly across the development electrode. The toning module preferably is seated at one level normally and is lifted to a second level to place the development electrode in toning proximity with the photoconductive surface of the electrophotographic member when the carriage carrying same arrives at the toning station. The translation of the carriage begins at a home station, preferably the imaging station, and the carriage is translated past a corona generating device at the charging station for application of an electrostatic charge potential to the photoconductive surface of the electrophotographic member carried thereby. After sufficient charge has been applied to said surface, the carriage is translated to the imaging station where the copyboard is raised to establish an intimate engagement with the charged photoconductive surface and radiant energy from a source thereof located below the copyboard is projected to the photoconductive surface through the transparency and the copyboard lowered. A latent electrostatic charge image thus is formed on said surface. The carriage then is translated to the toning station where the toning module has been lifted. Preferably, the toning module is raised to a level to be intercepted by the carriage, and particularly the platen, carried thereby. Resiliently biased slide means provided on the toning module adjacent the development electrode are intercepted by the entry of the platen into the toning station and forced downward against said bias whereby to establish a predetermined toning gap between the development electrode and the photoconductive surface during the passage of the surface through the toning station, the platen riding on said slide means.

One, two, three or more passes may be made by the platen before the carriage leaves the toning station and enters the transfer station. At the transfer station, a sheet of transfer medium, such as the conventional printing stock used by the printer and provided with registration holes, is mounted on a suitable mounting with the principal length thereof disposed interior of the housing. Means are provided to apply a selected amount of electrically insulating liquid to the printing stock before transfer is effected, roller means being provided to effect an engagement between the transfer medium printing stock and the toned photoconductive surface for transfer of the image to said printing stock. Means for applying an electrical bias voltage during both the toning and the transfer steps are provided to assist in said toning and transfer respectively. Subsequent to transfer, the carriage is returned to its home position, in the course of which, the platen passes a cleaning station at which means are provided for removing any residual toner remaining on the photoconductive surface subsequent to transfer as well as to discharge any residual charge potential which may have remained thereon. The steps described may be programmed, e.g. using microprocessor techniques, for automatic operation. Means may be provided for measuring the instantaneous charge on the photoconductive surface and limiting the charging when a predetermined uniform charge potential magnitude has been reached on said photoconductive surface. The toner liquid is continually circulated within said toning module and may be continuously flowing across said development electrode or may be distributed over said development electrode in a flow directionally the same as the direction of translation of said carriage and platen. Plural toning modules may be mounted in side by side array at said one level and means are provided for lifting a selected one of said modules to the second level. Each module contains a different toner, e.g. a different one of the primary color proof colors such as yellow, cyan, magenta and black, a different color separation transparency being substituted sequentially. The carriage with the platen mounted thereon is mounted on said guide means by a hinged coupling so that the carriage, etc. can be displaced for gaining access to the copyboard for loading and returned to superposed condition for processing. Hingable closure means are provided at the several stations to establish a light-tight engagement with the housing at said stations when the carriage is positioned thereat.

Shim means are provided for installation cooperatively with and as a part of said guide means for defining the precise path followed by the carriage.

DESCRIPTION OF PREFERRED EMBODIMENTS

Briefly, the invention provides an improved method and apparatus for making color proof copies from color separated transparencies using electrophotographic technique, said proof copies being applied to any printing stock selected by the user such as the same printing stock used for the final printing process whereby an accurate facsimile of the finished print can result. The apparatus contemplated herein is suitable for daylight operation with all functional stations housed within a light-tight enclosure. Each functional station has the functional means thereof capable of being brought selectively to operative position relative the photoconductive surface of an electrophotographic member. The electrophotographic member is mounted on a platen in turn seated on a linearly translatable carriage. The carriage is mounted on a guide arrangement for travel only along a linear path in a single horizontal plane. The sequential operations are capable of being preprogrammed, using electromechanical switching techniques or microprocessor techniques for automatic operation in a step-wise sequence from a home position through the respective functional stations for charging, imaging, toning, transfer and lastly to return to the home position during which cleaning occurs.

Figure 1:
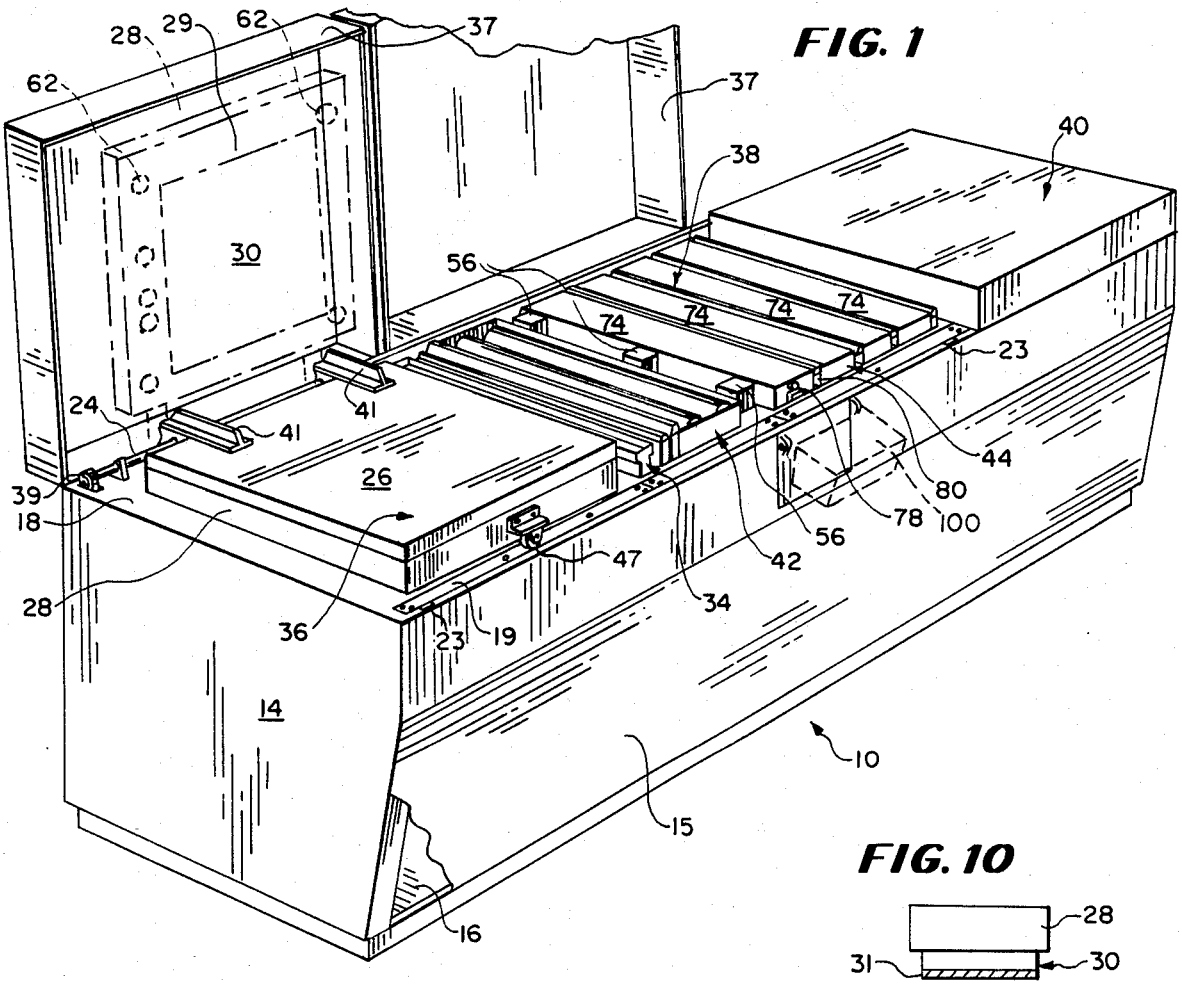
FIG. 1 is a perspective view of color proofer apparatus constructed in accordance with the invention.
Figure 2:
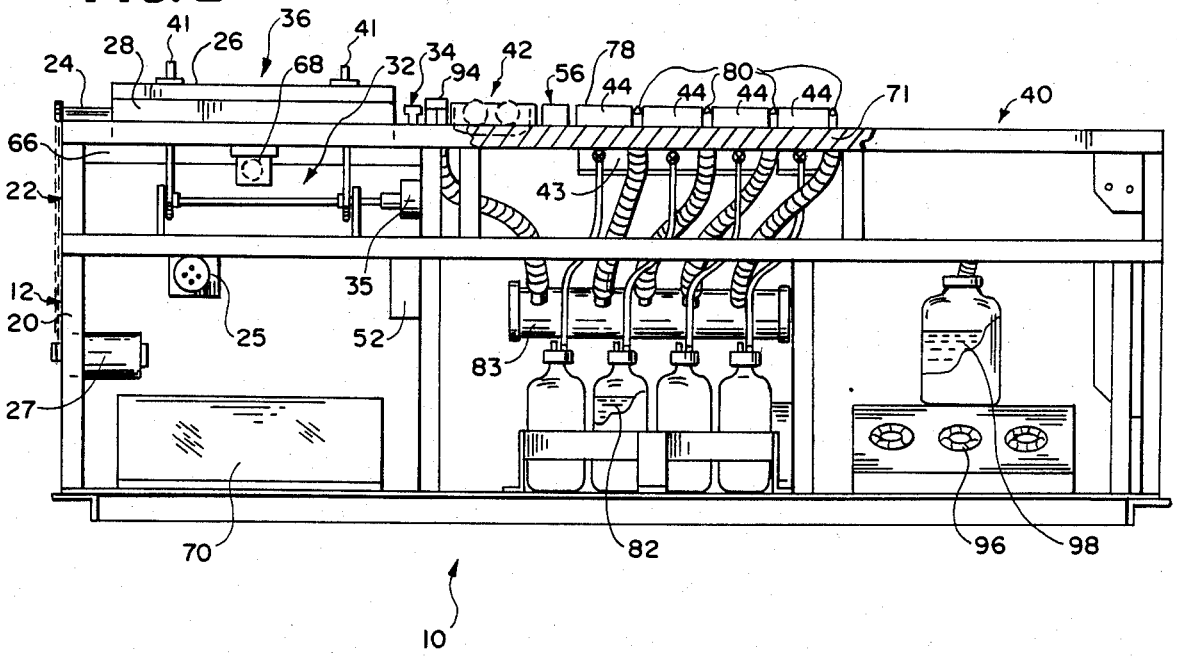
FIG. 2 is a front elevational view of the apparatus of FIG. 1 with a portion of the housing removed.
Figure 3:
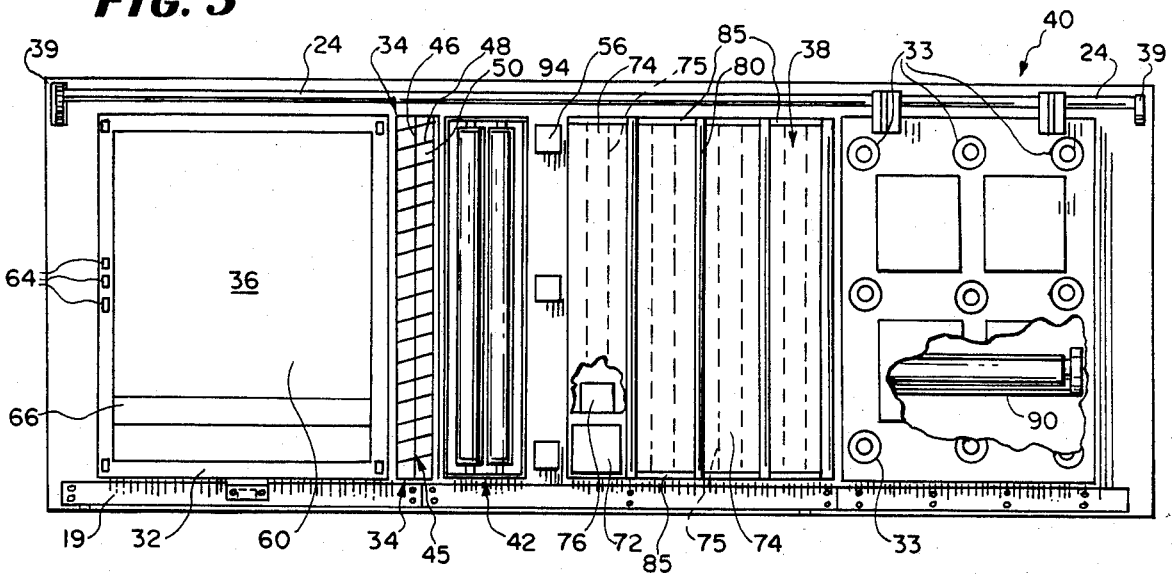
FIG. 3 is a top plan view of the apparatus of FIG. 1 with a panel removed and portions broken away to show interior details.
Figure 11:
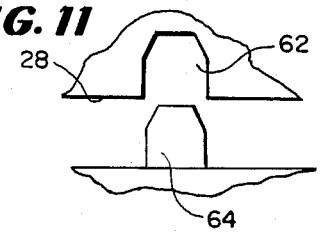
FIG. 11 is a fragmentary diagrammatic detail illustrating the registration means employed at both the imaging and the transfer station.

Referring to FIGS. 1 to 3 inclusive, an electrophotographic imaging machine 10, especially for color proofing, is illustrated as having a generally open, box-like framework formed of robust steel structural members 20 mounting panel members to form a light-tight housing 12. Housing 12 has opposite end walls 14, opposite side walls 15 and a base 16. A rectangular top frame 18 completes the housing 12. The functional or processing stations required for the electrophotographic processing are disposed within the interior of the housing 12 and include an imaging or exposure station 36, a charging station 34, a toning station 38, an image transfer station 40 and a cleaning station 42, each of which will be described hereinafter.

The invention further provides a carriage 26 of generally rectangular configuration and a platen 28 having a planar electrophotographic member-receiving surface 29 facing outwardly of the carriage 26. A guide rail 24 is journalled in opposite blocks 39 secured on the top frame 18 at opposite ends of the housing and extending along the length of the frame 18. A track 19 is secured along the opposite side of the top frame 18, also extending along the length of the same. Swingable closures 37 also are mounted on the top frame, each capable of seating upon the top frame 18 to define a light-tight relationship with the housing 12.

Figure 4:
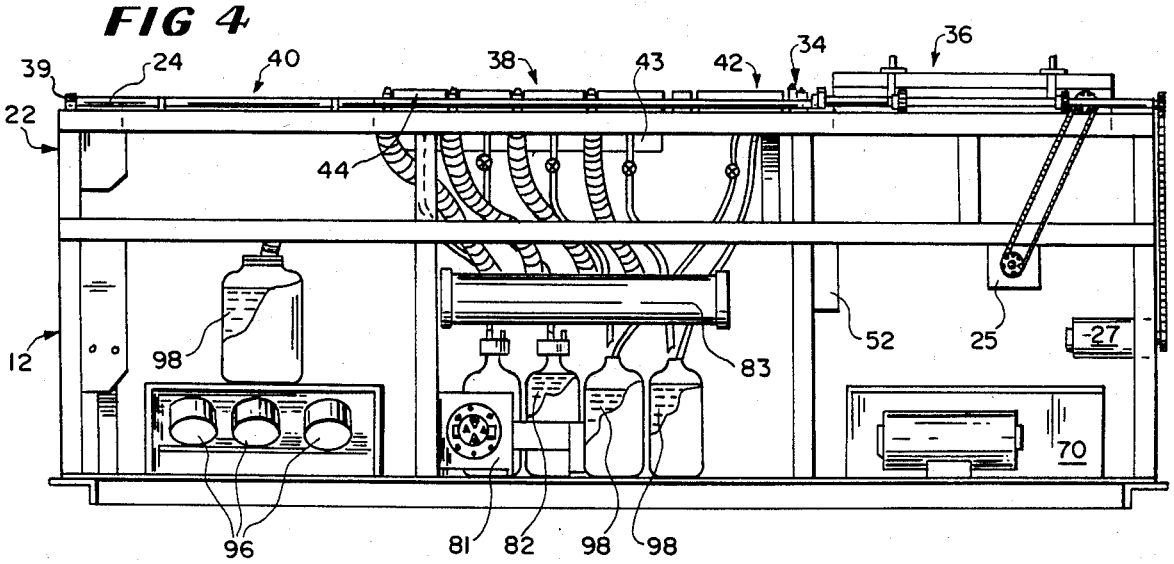
FIG. 4 is a rear elevational view of the apparatus of FIG. 1 with portions of the housing removed to illustrate transport mechanisms.

The housing 12 includes a subchassis mounted in the upper portion thereof, the subchassis being designated as 22 in FIG. 2. The subchassis 22 carrys the top frame 18 and rail 24. Alignment compensation shims 23 are used to adjust and set the desired horizontal planar orientation of the platen. The carriage 26 is driven through sprocket and chain by motor 25 and motor 27 as shown in FIG. 4. The speed of translation may be varied in the range of one to eight inches per second.

The carriage 26 is disposed in a generally horizontal planar orientation during translation along rail 24 and track 19 over the functional stations driven through sprocket and chain by motor 27. The carriage 26 is driven through sprocket and chain by motor 25 enabling a generally vertical planar orientation of the carriage 26 so that an electrophotographic member 30 conveniently can be installed onto the platen 28.

The couplings 41 are capable of being slidably moved along the rail 24 carrying therewith the carriage 26 and platen 28. Wheel 47 is mounted on the platen and ride on track 19 during motion of the carriage 26 and platen 28 together as an assembly.

The platen 28 is mounted on carriage 26 with the carriage 26 mounted to rail 24 by hinged couplings 41. The electrophotographic member 30 has a photoconductive coating 31 sputter-deposited on a conductive substrate secured onto the platen 28 by a vacuum force supplied by vacuum pump 81 and magnetic discs 33 provide ancillary support that prevent release of the downward facing electrophotographic member 30 in the event of vacuum loss, such as during normal shutdown. The electrophotographic member 30 also may be restrained from accidental release by clamping or adhesive means (not shown). An electrophotographic member 30 such as described in U.S. Pat. No. 4,025,339 granted May 24, 1977 is utilized herein with advantage.

Copyboard module 32, shown in FIG. 2, is located under the home position of platen 28 within subchassis 22. Module 32 will be described hereinafter when the imaging station is considered.

Referring to FIG. 3, the charging station 34 is provided with a corona charging device 45. One preferred charging device 45 comprises a fixed corona wire electrode 46 and a rotatable spiral corona ground plane member 48 wound on a rod 50 of electrically insulating material. Electrostatic sensors such as electrometers 56 are arranged adjacent the wire 46 with high voltage power supply 52 connected to the fixed corona wire 46. An electrical signal comprising an A.C. or R.F. signal generating circuit (not shown) in series with a negative D.C. voltage supply (not shown) is connected to the spiral corona ground plane member 48 in parallel with a high-value resistor (not shown), for example one hundred megohms.

The high voltage power supply 52 can provide either positive or negative voltage and is switchably connected to the fixed corona wire 46. The insulated rod 50 is rotatable by a drive motor (not shown) causing the spiral corona ground plane 48 to move helically relative to the fixed corona wire 46. The rotational rate may be, for example, 1000 R.P.M. Rotation of ground plane member 48 produces a relative motion respective with the fixed corona wire 46 that causes a substantially uniform and parallel corona cloud to be produced around the fixed corona wire 46.

The connection of the electrical signal to the spiral corona ground wire 48 further enhances the uniformity of the corona cloud produced. This is believed due to the pre-ionization effect wrought by the presence of high frequency energy on air as a stabilizing factor. As the carriage 26 moves in a linear path along track 19 and rail 24, the photoconductive surface 31 is transported over the corona field and the electrometer sensors 56 at a predetermined distance therefrom. The electrometers 56 measure the charge residing on the photoconductive surface 31. This measurement is provided as a meter reading. Feedback control responsive to said sensors 56 may be provided to the corona power supply circuit (not specifically illustrated) to assure that a proper uniform level of charge is applied to the photoconductive surface 31.

The polarity of the charge potential applied to the photoconductive surface 31 herein for imaging normally is negative as the photoconductive material of the electrophotographic member 30 is an n-type semi-conductor, namely, cadmium sulfide.

Accordingly, when the carriage 26 is translated past the corona charging device 45 in a first full pass, a positive polarity corona can be generated fully to discharge the surface 31.

The carriage 26 then is returned to the home position at the imaging station 36. During the return translation, the polarity of the corona discharge is reversed so that the charge potential applied to the surface 31 is of negative polarity. This change in polarity is effected by changing the polarity of the current directed to wire electrode 46. The conventional problem of ghosting caused by incomplete removal of the previous latent electrostatic image from the photoconductive surface 31 is overcome.

Figure 10:
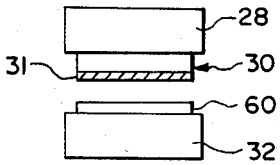
FIG. 10 is a diagrammatic detail of the platen of FIG. 3 and the copyboard of FIG. 2.

At the imaging station 36, the downwardly facing charged photoconductive surface 31 of the electrophotographic member 30 is exposed to radiant energy through a color separated transparency 60 from an energy source through a projection system located within said imaging station and located below the said surface and transparency (FIG. 10).

The platen next is translated horizontally to the toning station where one of plural toning modules is raised to a level for toning the electrostatic latent image of the pattern carried by said transparency 60.

Toning is effected with the assistance of an electrical bias voltage and may require one or more passes of the platen past the selected toning module. Subsequent to completion of the toning step, the photoconductive surface carrying the toned image then is translated to the image transfer station, where the toned image is transferred to a pre-wet sheet of the printing stock which is to be used for the ultimate printing job.

Preferably, transfer is assisted by application of an electrical bias voltage during the transfer process. Once transfer has been completed, the carriage and platen is returned to the home position.

During translation to the home position, the platen passes a cleaning station whereat any residual toner particles remaining on the photoconductive surface are removed, e.g. by a roller application of clear electrical insulating liquid. A squeegee or the like may be employed for wiping the photoconductive surface thereafter.

The platen also will pass the corona generating device 45 in returning to home position and hence may be cleaned by application of a charge of opposite polarity to the initial charge laid down thereby. A radiant energy lamp may be disposed across the path of said platen (also within the housing) so as to discharge any residual charge on said photoconductive surface.

As mentioned, the preferred embodiment of the machine invention is operable under "daylight" conditions enabled by hinged swingable closures or covers provided selectively for covering the top of the housing and thus assuring a light-tight environment. As will become apparent, the apparatus is compact and easily fabricated and serviced.

After the photoconductive surface 31 has been charged to the magnitude desired, the carriage 26 is driven by motor 27 along the track and rail 19, 24, transporting the platen 28 over the copyboard 32 at the imaging station 36.

The copyboard 32 is provided with upstanding pins 64 at locations about the transparency-receiving surface thereof. Matching sockets 62 are formed on the electrophotographic member receiving face of the platen 28. The color-separation transparency 60 is provided with registration holes and is mounted on the copyboard 32 with the pins 64 engaged through the registration holes of said transparency.

When the photoconductive surface 31 of the electrophotographic member 30 has been charged to the magnitude level desired, and the platen 28 is returned to the imaging station 36, the copyboard 32 is raised to an elevated position where the transparency is sandwiched engaged between the said surface 31 and the face of the platen. The pins 64 are engaged within the sockets 62 to assure registration. A lift motor 35 is provided operably coupled to the copyboard 32 to lift the copyboard 32 to its elevated position. A vacuum is drawn between the copyboard 32 and electrophotographic member receiving surface of the platen 28 so that the photoconductive surface 31 and the color separated transparency 60 sandwiched therebetween, is forced into an intimate engagement. A roller 66 is located within the copyboard assembly and below the transparency 60, said roller being arranged to be translated across the undersurface of the copyboard 32.

The roller 66 extends across the width of the copyboard 32 parallel thereto and rotates about its longitudinal axis as it is translated along the length thereof. The roller is arranged generally biased against the copyboard 32 to exert an upward directed force on transparency 60, thereby to remove any air trapped between the juxtaposed face of transparency 60 and the charged photoconductive surface 31.

A suitable folded type projection system, including radiant energy source 68 and mirror 70 is disposed at the imaging station 36 within the housing 12 and below the copyboard 32. A useful light source 68 can comprise a high intensity, compact filament lamp 68 such as a General Electric type 100 TB/ISC 100 watt lamp. The radiant energy source 68 light path is reflected by the mirror 70 to distribute effectively to the transparency 60. The source 68 is regulated to provide a predetermined amount of radiant energy.

Again referring to FIGS. 3 and 4 in the embodiment described, the toning station 38 consists of plural self-contained, mechanically interchangeable like toning modules 44, one for each liquid toner of the four primary toner colors, yellow, cyan, black and magenta.

The plural toning modules 44 are substantially identical and are slidable along a ball slide arrangement 43 mounted across the width of the subchassis 22 for removal and replacement, say for cleaning and for repair and/or servicing. The desired toner color may be selected manually at the beginning of a cycle. The selection may be preprogrammed for automatic operation. Each toning module includes a toner tray 44, a toner circulating pump 72, a toning development electrode 74 mounted on toner tray 44 across the top of the tray 44, a toner tray lift motor 76 and an articulated linkage secured to the undersurface of the tray and to the motor 76. A common vacuum pump 81 can be seated on base 16 coupled to an elongate manifold 83 for drawing a vacuum at each toner module via negative pressure nozzle 80 which can be provided extending along the length of toner tray 44 and adjacent thereto as shown in FIGS. 1, 2 and 3. The vacuum nozzle 80 is arranged to suck up any excess liquid toner remaining on the surface 31 after a pass has been made.

The toner circulating pump 72 constantly agitates and recirculates the liquid toner 82 throughout the interior of tray 44 so as to keep the toner particles thereof dispersed. The liquid toner circulating pump 72 is of the low shear type and located exterior of the toner tray 44 in order to minimize the temperature rise of the liquid toner 82.

The toner tray 44 containing the selected color toner 82 is raised to an elevated position by toner lift motor 76. The toner lift motor 76 may be small, a 0.01 horse power gear motor being adequate. A pair of anti-friction slides 85 (FIG. 3) are secured to opposite ends of toning development electrode 74 extending a predetermined distance above the planar top surface of electrode 74 to effect a typical 0.015 inch toning gap between development electrode 74 and photoconductive surface 31.

The development electrode 74 is spring mounted so that it has a limited movement although it is biased outward of the tray 44. When the platen 28 is translated into the toning station 38, its leading edge engages the antifriction slides 85 displacing the development electrode 74 downward against its normal bias. Thus the toning gap is established and maintained as long as the development electrode is effective during the passage of the platen 28 thereover.

Figure 6:
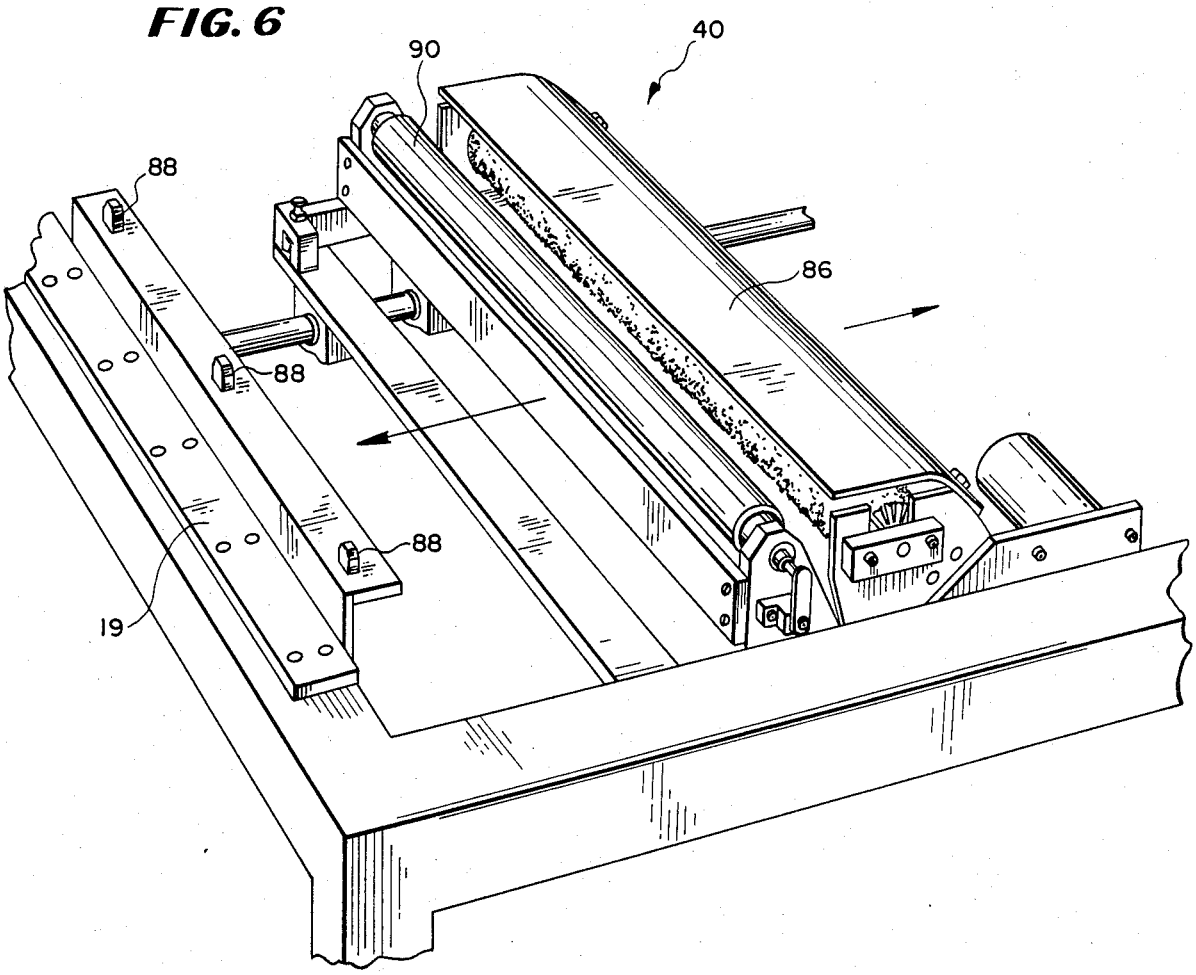
FIG. 6 is a fragmentary perspective view illustrating the structure for mounting a transfer medium and transferring the toned image thereto at the transfer station.

Liquid toner 82 contains toner particles dispersed in an electrically insulating fluid dispersant such as the hydrocarbon sold under the trademark ISOPAR. Minute residual potentials or noise voltage attract small amounts of toner particles, or the dispersant may evaporate and the toner particles mechanically fall on photoconductive surface 31 of the electrophotographic member 30, producing background fog. A low electrical bias voltage of the order of two volts D.C. is applied between the development electrode 74 and the photoconductor surface 31 to minimize the background fog effect of any residual toner. Clear electrical insulating liquid 98 can be dispensed over the surface 31 before the platen 28 enters the toning station 38. This can be performed by an arrangement similar to that of pre-wet mechanism 86 shown in FIG. 6, also to significantly reduce background fog.

The development electrode 74 can be provided with parallel slots 75 therein that extend substantially the length of the electrode adjacent but inward of the opposite edges of electrode 74, thereby enabling the flow of toner 82 across the development electrode 74. The toggle valve 78 provides for flow of the toner 82 in a bidirectional manner, coinciding with the direction of the platen 28 movement. The valve 78 preferably may be mechanically actuated or may be electrically activated. Mechanical actuation economically is preferable. The latent electrostatic charge image on surface 31 may be fully toned in three successive reciprocable passes of the platen 28 over the development electrode 74 having toner 82 flowing thereacross. It is possible to require fewer passes.

The liquid toner alternatively can be permitted to flow continuously across the development electrode 74 of the toning unit assembly. In such operation, flow is permitted simultaneously from both slots 75 flooding the gap established between the development electrode 74 and the photoconductive surface 31 during each pass of the platen 28. With such modification, the directional valve 78 need not be provided. In the practice of the invention, entirely satisfactory toning performance is achievable with constant flow, while at the same time alleviating problems attendent with toner settling out or caking on the development electrode or feed slots when toning flow is inhibited. Even where toner liquid is flowed continuously over the development electrode, it is believed necessary to vacuum clean the photoconductive surface to assure freedom from excess liquid or floating toner particles are removed except those adhering to the imaged areas of surface 31 due to charge attraction toward the platen 28. The carriage 26 and platen 28 are translated toward the transfer station 40 after toning is completed.

Referring to FIGS. 2, 3, 6 and 8, the transfer medium 84 which can comprise the user's typical printing paper or the like (e.g., ordinary printing stock), is mounted manually by engaging the conventional registration holes onto the registration pins 88. Transfer medium 84 is pre-wet with electrical insulating fluid 98 by pre-wet mechanism 86. The illustrated pre-wet mechanism 86 shown in FIG. 6 could be replaced by a plurality of spray mechanisms similar to those used for spray painting. The electrically insulating fluid 98 is the same narrow-cut isoparaffinic hydrocarbon fraction sold by Exxon Company of Houston, Tex. under registrated trademark ISOPAR.

Prewetting is employed to avoid uneven absorption of the wet toner suspension from the photoconductive surface, serving as a type of lubricant to assure uniform image transfer without blotches. The platen's registration sockets 62 are engaged by registration pins 88. One method of transfer contemplated by the invention involves the extension of transfer roller 90 pressing the transfer medium 84 into intimate contact with the electrophotographic member 30 while a relatively high positive voltage on the order of 500 to 3000 volts d.c. is applied to prevent image shift during medium lay-out over the image. A negative voltage on the order of 500 to 2500 volts D.C. can be applied during return or retraction of the transfer roller 90. The high intensity electric field which is induced proximate with the line contact break between the transfer roller and the imaging surface as enhanced by the mechanical separation rate therebetween as related to the well understood DV/DT equation brings about the transfer at the toner pigments from the photoconductor surface to the transfer medium. Hot air dryer fans 96 act to dry or evaporate any remaining fluid 98 on the transfer medium 84.

After the image transfer is completed, the carriage 26 is driven by the motor 25 back along track 19 and rail 24 transporting the platen 28 to its home position, here over the copyboard 32 at the imaging station 36. During the return travel the photoconductive surface 31 of the electrophotographic member 30 is cleaned.

The transfer medium 84 may hang freely from the pins 88 into the framework of the apparatus 10, or a weighted member may be clamped along the free edge thereof and/or guide rails or grooves to restrict lateral movement can be provided.

This guide system comprises a pair of spaced facing rails 95 along the longitudinal edges of the transfer medium, e.g. paper printing stock so that the printing stock will not flutter freely or move laterally out of registration. The steady support of the paper contributes much to assure accurate registration of each superimposed color.

Achievement of registration during transfer can be assisted by providing a driven cam-like arrangement (not shown) coupled with rocker arms which push additional registration pins provided on the platen 28 into corresponding sockets adjacent pins 88. The transfer process shall be described later.

Figure 5:
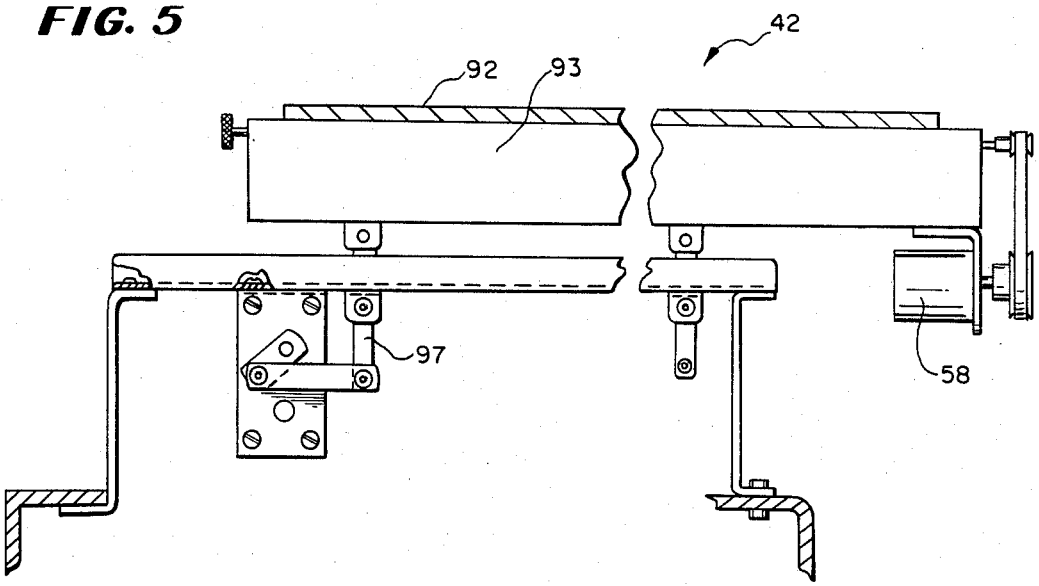
FIG. 5 is a fragmentary elevational section illustrating the cleaning station.

The first operation in cleaning the electrophotographic member 30 may be to discharge the photoconductive surface 31 by exposure to a source of light. This facilitates the removal of toner 82 through discharge of residual electric affinity between the surface and the toner. The cleaning station assembly 42 is illustrated in FIGS. 2 and 5. The cleaning function is provided by two motor (58) driven counter-rotating rollers 92 and a cleaning vacuum nozzle 94. The rollers 92 are immersed in electrical insulating liquid 98, the same type of liquid employed to prewet the transfer medium 84, same being held in container 93. Container 93 is mounted on an articulated linkage 97 so that it normally is at a lowered position (inactive) until triggered by the return translation of the carriage after transfer is complete. The cleaning station 42 is raised, elevating wetted rollers 92 into contact engagement with the photoconductive surface 31. A vacuum can be applied at vacuum nozzle 94 to remove remaining insulating liquid from the surface 31. After vacuuming is completed, the surface 31 passes over the corona electrode 46 and a field is applied which serves to fully discharge any residual negative photoconductive surface charge, positive corona eliminating any field memory which could produce ghosting in subsequent images.

Figures 7, 8:
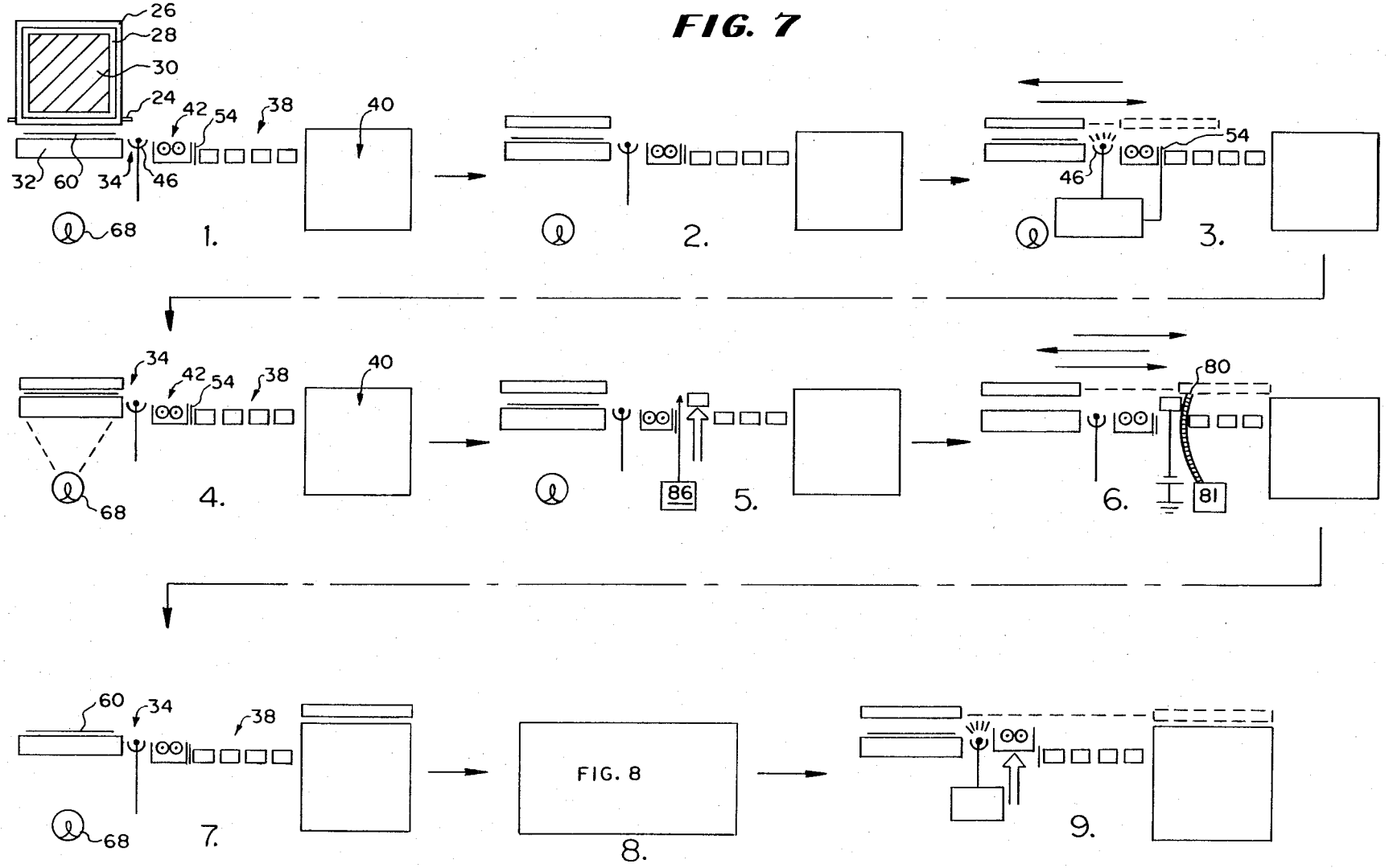
FIG. 7 is a diagram illustrating the process of making color proofs according to the invention.
FIG. 8 is a more detailed diagram illustrating the transfer step occurring at the transfer station.
Figure 8:
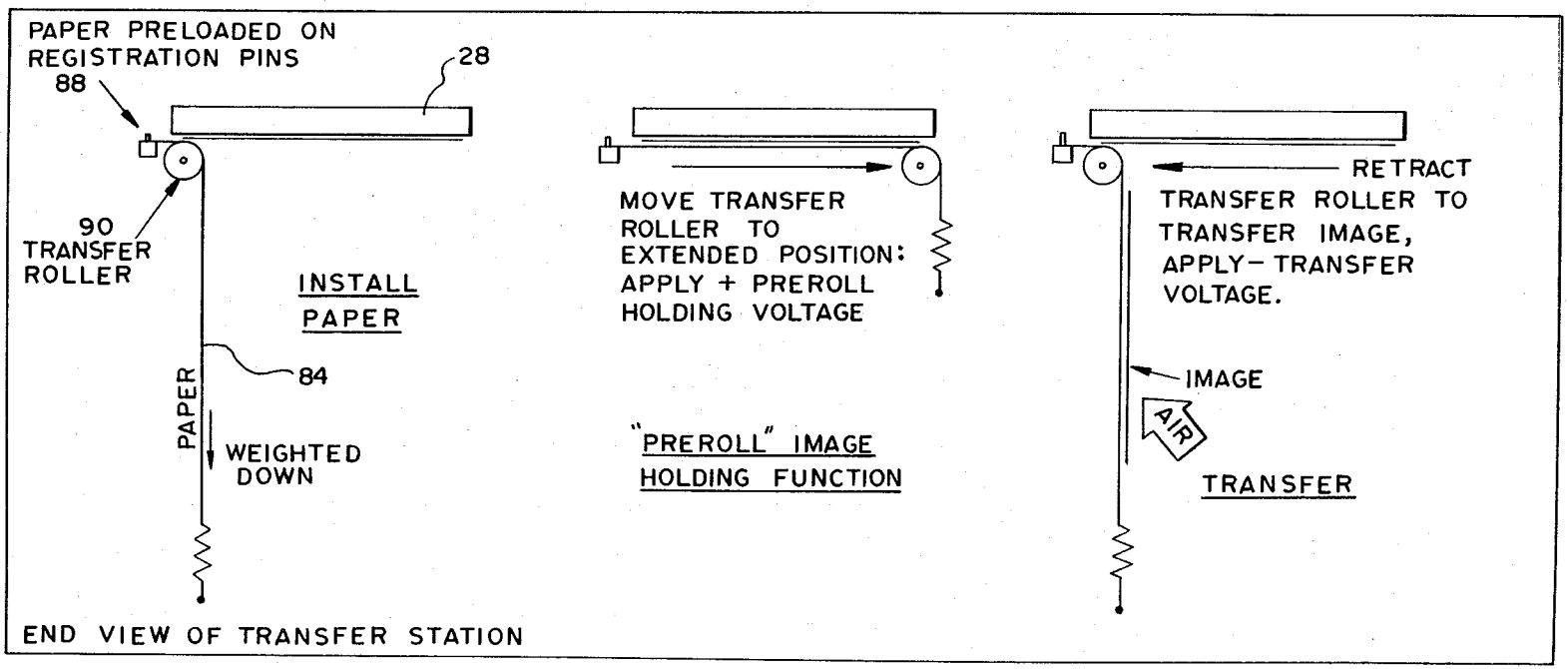

Attention is now invited to FIGS. 7 and 8 wherein the process of the invention is diagrammatically represented during which a print copy can be made with the apparatus 10 according to the invention. The chart of FIG. 9 graphically represents the timing of the events involved.

The operator desiring to make a print copy first would turn on the power and install an electrophotographic member 30 onto the platen 28, first raising the platen 28 to reach generally vertical position. The separate toning modules 44 of the toning station 38 have been loaded with the correct liquid toners 82 desired and the appropriate color separation transparency 60 is engaged on the registration pins 64 of cobyboard 32. The transfer medium 84 is mounted onto the registration pins 88 at the transfer station 40. This is identified as step 1 of FIG. 7. The operator then lowers the platen 28. This is illustrated as step 2 in FIG. 7, and is designated as time T0 on the chart of FIG. 9. The apparatus 10 is light sealed by the hinged closures 37 until the image transfer function for the selected toner color 82 has been initiated.

Figure 9:
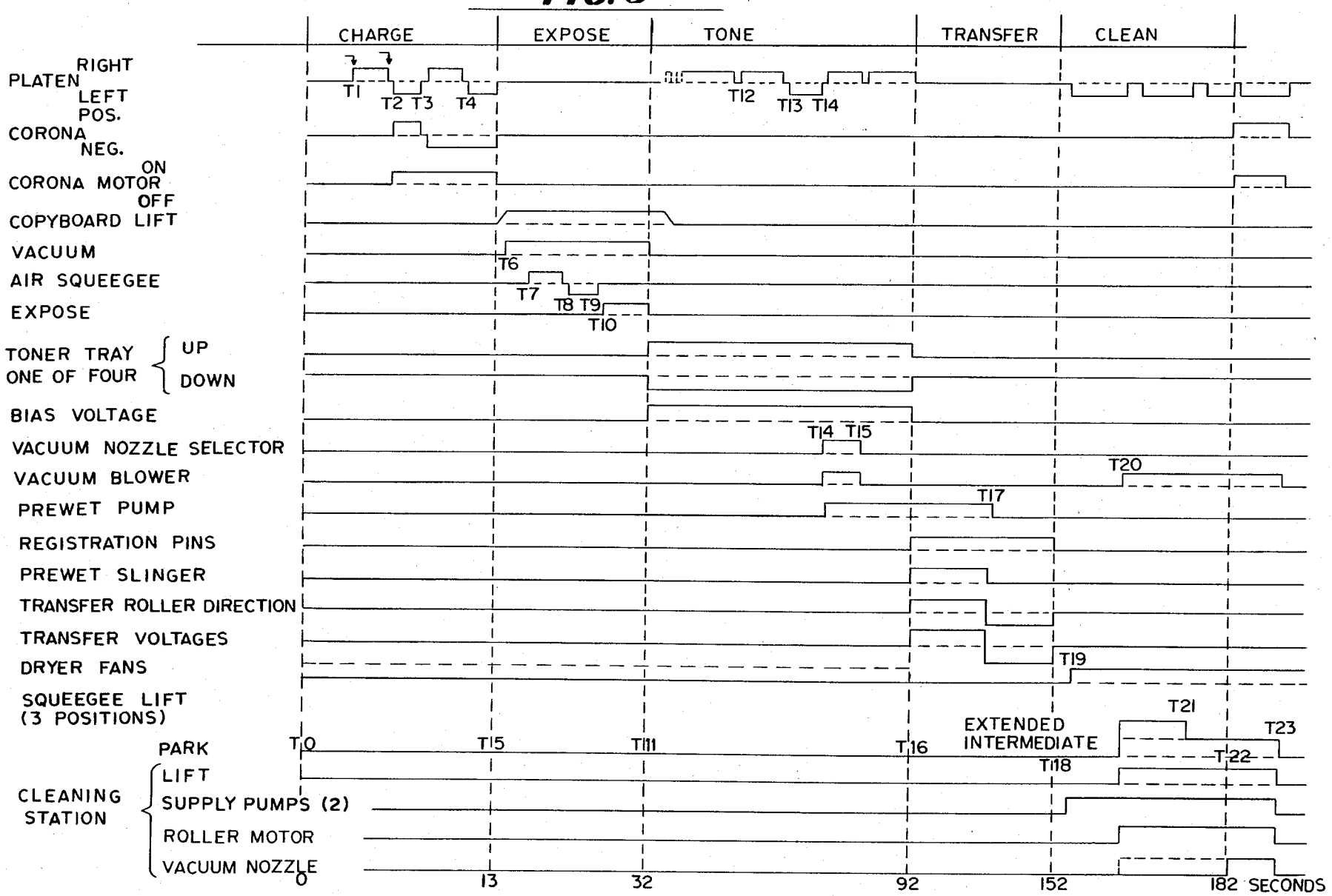
FIG. 9 is a timing diagram showing the operation of the apparatus according to the invention.

Step 3 of FIG. 7 illustrates the charging function which is represented on the chart of FIG. 9 from time T0 to the time T5. At time T1 the platen 28 starts moving from its home positon over the copyboard 32 to a second position over the toning station 38 which it achieves at time T2. At time T2 the corona generating device is energized. A positive corona first is produced to discharge, and thereby fully to ready the electrophotographic film 30 as the platen 28 is moved back to its home position. Next, the corona current polarity is reversed, becoming negative at time T3, and a negative corona is applied to surface 31 of member 30. The platen 28 usually makes two passes over the charging station 34 in a reciprocating manner to complete the charging of the photoconductive surface 31 to a predetermined (or desired) magnitude level. During the charging function, the platen 28 may travel for example, at a speed of four inches per second, giving a charging function time of thirteen seconds. The usual travel speed range is about one to eight inches per second.

Next, the imaging or exposing function occurs between the time of T5 to the time T11, for example, approximately nineteen seconds, illustrated in step 4 of FIG. 7. At time T5, the copyboard lift motor 35 raises the copyboard structure 32 in position for intimate registered engagement of the copyboard and the transparency 60 with the platen 28. At time T6 a vacuum is drawn effectively between the copyboard supporting transparency 60 and the platen face supporting the photoconductive surface 31.

A motor driven roller 66 mounted in the copyboard 32 serves to squeegee any physical separation (e.g., air bubbles) between the platen face including the electrophotographic member 30 and the transparency 60 surface facing the member. Roller 66 starts travel at time T7 and travels the length of transparency 60 reaching the opposite end thereof at time T8 and retracts to the roller's starting position which it achieves at the time T9. The vacuum is drawn during the time T7 to T9. The imaging light source 68 is energized at time T10, projects a predetermined amount of radiant energy to the engaged transparency 60 and photoconductive surface 31, ceasing at time T11. The electrophotographic member 30 now has a latent electrostatic image of the pattern carried by the transparency 60 on the exposed photoconductive surface 31. The exposure time between T10 and time T11 is typically ten seconds, but is adjustable over a range of one to ninety-nine seconds.

The vacuum between the platen 28 and the copyboard 32 is relieved to air at time T11 and the copyboard 32 structure is retracted downward, away from the platen 28, releasing the platen 28 for lateral travel.

The toning function begins at time T11 and extends to time T16. At time T11 selected toner tray 44 is raised to an elevated position by lift motor 76. The selected bias voltage is applied to the platen 28 at time T11 as a positive level appropriate for the selected color, usually on the order of two volts. Where flow is directional, a short time delay is required to allow time for the flow of toner 82 across development electrode 74. The photoconductive surface 31 is prewet with fluid 98, which aids in reducing fogging of the final image because the surface 31 is already wet before coming in contact with the toner thereby acting to lubricate the photoconductor surface as a virtual barrier to direct toner particle contact with the photoconductive surface. The platen 28 starts its travel to the toning station 38. Toning is provided at time T12 with the first pass of the platen 28 over toning electrode 74 for the selected color, a second back pass starting at time T13 and final forward third pass over the development electrode 74 starting at time T14 and being completed at T15, illustrated in step 6 of FIG. 7. Where cleaning of residual toner from the surface 31 is required at time T14 vacuum pump 81, usually in the form of a vacuum producing turbine similar to the type employed in a vacuum cleaner, is activated to provide a vacuum at vacuum nozzle 80 adjacent toner tray 44 to remove any excess unattached toner from the photoconductive surface 31. A squeegee (not shown) can be mounted on the platen 28 so that it may be lowered to contact the development electrode 74 on the last pass to remove toner 82 therefrom. The platen 28 continues to move now toward the image transfer station 32, at the speed of six inches per second (with toning completed) compared to about one and one-half inches per second during the toning function. The total time of the toning function with the above denoted platen speed may be slightly under one minute.

Step 7 of FIG. 7 illustrates the platen 28 in the transfer position 40. The color separated transparency 60 for the next color cycle can be installed at this time without raising the platen 28, which is at its other extreme of travel. At time T14 the prewet mechanism 86 is activated. The transfer medium 84, e.g. paper, is prewet with fluid 98. At time T16 the registration pins 88 engage the registration sockets 62 in the electrophotographic member-supporting platen 28, a prewet slinger mechanism 86 or (a spray device) prewets the transfer medium 84. The transfer roller 90 is translated while preferably an electrical bias voltage predetermined for the selected color simultaneously is applied to effect transfer of the toned image to the wet medium 84. The transfer roller 90 is translated from time T16 to time T17. At time T17, the transfer roller 90 retracts. No bias voltage is mandatory during the return of the transfer roller. Dryer fans 96 are started at time T19. The total time for the image transfer function is less than one minute.

When the transfer of the toned image to the transfer medium is completed, the carriage 26 along with the platen 28 is return translated back to the home position, here, the imaging station. The cleaning station 42 is located along the path of the carriage 26 (and platen 28) for removing any residual toner from surface 31 and fully discharging said surface of any residual charge potential.

In the preferred embodiment a 30 watt fluorescent lamp is provided. The pair of counter-rotating rollers 92 are wetted with electrically insulating liquid and activated at time T19, elevated at time T20 and at time T22 contact the photoconductive surface 31. At time T22 vacuum is provided at nozzle 94 for removing any residual toner. The cleaning function is completed at time T23 and the platen 28 is back at the home position. During the cleaning function the platen speed may be, for example, one-inch per second giving a cleaning function total time of about one half minute. Using these exemplary platen speeds the total time for a single color transfer may be approximately three minutes; thus a color proof may be completed in about twelve minutes from a set of four color separated original transparencies. After cleaning, the photoconductive surface 31 is fully discharged of any remaining charge with a positive corona field. The color imaging cycle is completed. The surface 31 is ready to proceed with the next color imaging cycle for achieving the full color proof copy.

As mentioned earlier, a programming module may be installed so as to enable fully, or partially automatic operation of apparatus 10. The module, represented by reference character 100 in FIG. 1, can comprise conventional microprocessing control logic, operably coupled to apparatus 10 or alternatively may comprise a conventional electromechanical system of switching and relays arranged to operate in a predetermined order in accordance with the timing and functional requirements discussed earlier herein.

The method and imaging apparatus 10 of the invention produces a high resolution print copy. Manual machine controls are provided to minimize background fog and adjust density. Automatic measurement of the amount of charge applied to the photoconductive surface may be provided and means may be provided to control the amount of charge applied to the photoconductive surface in proportion with the measured charge. The apparatus 10 provides for daylight operation and the member is handled in ambient light without performance sacrifice. The toning station is arranged to facilitate cleaning by removing the desired modules. Automatic cleaning of the electrophotographic member is provided as part of each transfer cycle. The apparatus 10 is faster than prior machines not utilizing the invention.

Many variations are capable of being made without departing from the spirit or scope of the invention as defined in the appended claims.

What is desired to be secured by Letters Patent of the United States is:

1. In an electrophotographic imaging apparatus for producing a print copy of a pattern carried by a transparency in which the apparatus includes a supporting framework defining an internal area and means cooperating with said framework defining a light-tight housing, a platen assembly, the platen assembly having an electrophotographic member receiving surface and constructed and arranged for translatory movement lengthwise along said framework in a predetermined linear path substantially the entire length of said housing past a plurality of stations including a charging station, an imaging station, a toning station and a transfer station arranged sequentially within the housing and along said path, means for securing an electrophotographic member on said surface of the platen assembly, the electrophotographic member including a photoconductive surface and secured to the platen assembly, said platen assembly adapted to be positioned at the imaging station with the photoconductive surface facing inwardly toward the housing, the charging station being adjacent the imaging station and including corona generating means for applying the charge potential to the photoconductive surface, the imaging station including a copyboard having means for mounting the transparency thereon facing toward the photoconductive surface, means for establishing engagement between the transparency and the electrophotographic member subsequent to charging of said photoconductive surface, a source of radiant energy and means for projecting radiant energy through the transparency subsequent to application of a charge potential to the photoconductive surface such that exposure of the charged surface to the radiant energy will produce a latent electrostatic image of the pattern on the exposed photoconductive surface, the toning station including means for depositing liquid toner on the photoconductive surface for rendering the latent electrostatic image visible, the transfer station including means for transferring the toned image to the transfer member, means for sequentially translating the platen assembly along said linear path between stations, the improvement comprising cooperating registration means provided at both the imaging and transfer stations to achieve required registration between the transparency and electrophotographic member at the imaging station and between the electrophotographic member and transfer member at the transfer station independently of the relationship of the functional elements at such stations relative to the framework, cooperating guide means on the framework and platen assembly defining the path of movement of said platen assembly from station to station with the photocoductive surface facing inwardly toward each station during such movement and means on the toning module to render the definition of the toning gap independent of the relationship of the platen assembly or the toning module to the said framework.

2. The invention as claimed in claim 1 in which the toning station comprises a toning module including a development electrode, means for holding a store of toning fluid, means for directing a flow of toning fluid from said store to and over said development electrode, said toning module arranged for placement of the development electrode at a level in toning proximity to the photoconductive surface when the assembly passes through the toning station.

3. The invention as claimed in claim 2 in which the toning station includes at least a pair of toning modules each being of substantially the same construction but holding a different toning fluid, each toning module having a development electrode, a store of toning fluid, means for directing toning fluid from said store to and over the development electrode, all the toner modules being mounted at a first level spaced from toning proximity to the photoconductive surface when the assembly passes through the toning station and means for bringing one of the toning modules to a level where the development electrode thereof is in toning proximity to the photoconductive surface.

4. An electrophotographic imaging apparatus for producing a copy of a pattern carried by a transparency and the apparatus comprising:

A. a supporting framework within a light-excluding housing,

B. a carriage and platen assembly, said framework and assembly having cooperating means for translation thereof along said framework in a linear horizontal path along substantially the entire length of the housing, C. a plurality of relatively independently operating stations along the path comprising an imaging station, a charging station, a toning station and an image transfer station, the apparatus including means for translating said assembly in accordance with a preset program to bring the platen step-by-step to and past said stations in a predetermined sequence whereby to have certain functions performed at the respective stations, D. said platen providing a sheet-receiving surface facing inwardly toward said housing during movement of said platen, said platen arranged to receive on said sheet-receiving surface an electrophotographic member in sheet form having a photoconductive surface, means on the platen for mounting the electrophotographic member flat against the sheet-receiving surface with the photoconductive surface exposed to the interior of the housing, said sheet-receiving surface being parallel to the plane of said linear path along which said platen is moved during functional operation at said stations, E. a copyboard disposed at said imaging station, said copyboard having a transparency-receiving surface within the housing arranged in face to face alignment with and parallel to said platen surface and below the same when said platen is at said imaging station, the copyboard being mounted to said framework and there being means for raising and lowering said copyboard relative to said platen between a first position in which said transparency-receiving surface is spaced below said sheet receiving surface and a second position in which said transparency-receiving surface lies substantially in the same plane as said sheet-receiving surface, whereby, when said sheet-receiving surface carries an electrophotographic member, the copyboard carries a transparency and the platen is at said imaging station, the transparency will be in contact with the photoconductive surface when said copyboard is in said second position, F. means at said imaging station for exposing said photoconductive surface to radiant energy through the transparency when the photoconductive surface is in contact with the transparency to form an electrostatic latent image of the pattern of said transparency on said photoconductive surface, G. said charging station having corona means for applying a charge to said photoconductive surface as the photoconductive surface passes said charging station prior to movement of said platen to said imaging station, H. said toning station having a toning module disposed at a first level, means to raise said module to a second level proximate the path of the platen including a resiliently biased planar surfaced development electrode, means for holding a store of toning fluid, means for depositing toning fluid on said electrode, means to establish a precise toning gap between the photoconductive surface and the development electrode, said last mentioned means including means resiliently biasing the development electrode outward of the toning module and means adjacent the development electrode capable of being engaged by the platen, said toning module being disposed with said development electrode directed upward into intercepting relation with the path of travel of said platen and said platen being engageable therewith to displace said electrode against its resilient bias so as to establish a precise uniform toning gap between the photoconductive surface and the planar development electrode to provide contact between toning fluid carried by said electrode and said photoconductive surface when any part of said platen is at said toning station whereby all of said surface will be contacted when the platen passes through said toning station, and I. said transfer station including means for mounting a transfer medium in a disposition to be brought into transfer engagement with the downwardly facing sheet-receiving surface when said platen is at said transfer station, means for prewetting the transfer medium and means for causing transfer engagement between said medium and said photoconductive layer when said platen is at said transfer station whereby to transfer any developed image on said layer to said transfer medium and J. registration means at both said imaging and transfer stations cooperable with the displaceable development electrode means to render the disposition of the functional operating stations independent of their disposition in relation to the framework.

5. The invention as claimed in claim 4 in which there is a cleaning station within the housing proximate the plane of travel of said platen assembly and means at the cleaning station for clearing the photoconductive surface of any residual toner subsequent to completion of transfer of the toned image.

6. The invention as claimed in claim 4 in which the charging station is between the imaging station and the toning station and the said program means is arranged to commence the movement of the assembly in said planar linear path from a home position at the imaging station to the charging station in one direction, reversing the movement after the operation of the corona means at the charging station so that the assembly moves back to said home position, the operation being operative to produce said latent image at said imaging station, the assembly thereafter being programmed to move in said one direction past the charging station to said toning station, said corona means being inoperative during said last mentioned passage.

7. The invention as claimed in claim 6 in which there is a cleaning station within the housing proximate the plane of travel of said platen assembly and means at the cleaning station for clearing the photoconductive surface of any residual tone subsequent to completion of transfer of the toned image.

8. The invention as claimed in either claim 4 or claim 6 in which said toning station has a plurality of toning modules having substantially the same construction as said aforementioned toning module, each module adapted to carry a different color toning fluid, all of the toning modules being mounted at a second level below said first-mentioned level and being provided with means for selecting one of said toning modules and raising only the selected one of said toning modules to said first-mentioned level selectively for interception by said platen as the assembly passes through said toning station, the extent of interception into said linear path being equatable with the variation in the relative planarity of platen travel during the translational movement along said linear path whereby to enable a plurality of said programs to be effected, each adapted to image a different transparency and with a different color toning liquid on the same transfer medium means to lower the selected one toning module after toning.

9. The invention as claimed in either claim 4 or claim 6 especially for producing the registered prints of a plurality of color separation transparencies of a colored composite on the same transfer medium and in which the transparencies have identically placed, registration means for effecting registration of all of said transparencies, pin registration means on said transparency-receiving surface whereby to enable each transparency to be individually placed alone on said copyboard but in a position whereby it is in registered placement with the positions occupied by the others of the transparencies when placed on said copyboard.

10. The invention as claimed in either claim 4 or claim 6 especially for producing the registered prints of a plurality of color separation transparencies of a colored composite on the same transfer medium and in which the transparencies have identically placed registration means for effecting registration of all of said transparencies, the said copyboard having cooperating registration means on said transparency-receiving surface whereby to enable each transparency to be individually placed alone on said copyboard but in a position whereby it is in registered placement with the positions occupied by the others of the transparencies when placed on said copyboard, and in which said toning station has a plurality of toning modules having substantially the same construction as said aforementioned toning module, each module adapted to carry a different color toning fluid, all of the toning modules being mounted at a second level below said first-mentioned level and being provided with means for bringing a selected one of said toning modules to said first-mentioned level just prior to passage of the assembly into said toning station whereby to enable a plurality of consecutive programs to be effected, each adapted to image a different transparency of the said plurality of color separation transparencies and with a different color toning fluid on the same transfer medium.

11. The invention as claimed in either claim 4 or claim 6 and roller means mounted within said copyboard below said transparency-receiving surface and means for translating said roller means across said transparency and engaged therewith for eliminating any voids between the photoconductive surface and the transparency once same are engaged.

12. The invention as claimed in either claim 4 or claim 6 and squeegee means mounted within said copyboard below said transparency-receiving surface and means operable when said copyboard is in said second position to draw said sqeegee means across the underside of said transparency-receiving surface for removing any voids between said transparency and said photoconductive layer once same are engaged.

13. The invention as claimed in claim 12 wherein said squeegee means comprise a roller member and drive means for translating said roller member across said transparency-receiving surface and guide means for defining the path of said roller.

14. The invention as claimed in either claim 4 or claim 6 especially for producing the registered prints of a plurality of color separation transparencies of a colored composite on the same transfer medium and in which all the transparencies have identically placed registration means, said cooperating registration means on said transparency-receiving surface enabling each transparency to be individually positioned whereby to be in registry, said toning station having a plurality of said toning modules identical but for the different color toning fluid therein, all of the toning modules being mounted at the second level below said first-mentioned level and being provided with means for bringing one of said toning modules to said first-mentioned level selectively as the assembly passes through said toning station whereby to enable a plurality of consecutive programs to be effected, each adapted to image a different transparency of the said plurality of color separation transparencies and with a different color toning fluid on the same transfer medium.

15. The invention as claimed in either claim 4 or claim 6 especially for producing the registered prints of a plurality of color separation transparencies of a colored composite on the same transfer medium and in which all the transparencies have identically placed registration means cooperating with said cooperable registration means on said transparency-receiving surface at the imaging station enabling each transparency to be individually positioned whereby to be in registry, said toning station having a plurality of said toning modules which are identical but for the different color toning fluid therein, all of the toning modules being mounted at the second level below said first-mentioned level and being provided with means for bringing one of said toning modules to said first-mentioned level selectively as the assembly passes through said toning station whereby to enable a plurality of consecutive programs to be effected, each adapted to image a different transparency of the said plurality of color separation transparencies and with a different color toning fluid on the same transfer medium and means for drawing a vacuum between said engaged surfaces when said copyboard is in said second position.

16. The invention as claimed in claim 4 or claim 6 wherein said means for exposing includes a source of radiant energy located below said copyboard and means arranged within said housing at said imaging station for projecting said radiant energy upward through said engaged transparency and photoconductive surface.

17. The invention as claimed in claim 4 or claim 6 and means for hingedly mounting said platen on said housing.

18. The invention as claimed in claim 4 or claim 6 wherein said means cooperating to define said predetermined linear path comprise rail means on said housing, rail-mounting means on said assembly and shim means selectively located between said rail means and said housing along the length of said housing cooperating for defining the linear path along said length of said housing followed by said assembly during translation thereof.

19. The invention as claimed in claim 4 or claim 6 and at least one cover member hingedly coupled to said housing, said cover member constructed and arranged to effect a light-tight engagement with said housing at each of said stations while said carriage is positioned thereat.

20. The invention as claimed in claim 4 or claim 6 wherein there are a plurality of cover members at each of said stations, each being hingedly coupled to said housing, each cover member constructed and arranged to effect a light-tight engagement with said housing at each of said stations at least when said carriage is positioned thereat.

21. In a method for producing an electrophotographic image comprising the essential steps of: providing an electrophotographic medium on a carrier therefor; translating the carrier and medium together over a predetermined linear path; charging the medium at a first path position; exposing the medium to a light borne image at a second path position; providing effective toning elements resiliently biased toward the carrier; toning the less exposed portions of the image bearing charged region of the medium to produce an effectively visible image; utilizing the visible image for a purpose; the improvement comprises the further steps of: positioning the effective toning elements into intercepting relationship relative to the linear path; producing substantially constant spatial relationship between the image bearing charged region of the medium and the effective toning elements by causing the carrier to displace the toning elements against the resilient bias thereof upon interception by the carrier; and maintaining the spatial relationship independently of any variations of the linear path of said medium in that the effective toning elements thereafter being resiliently biased against the carrier until toning is completed.

22. The method of claim 21 having the further step of: tranferring the visible image from the electrophotographic medium to an image receiving substrate.

23. The method of claim 22 having the further step of: fixing the transferred image to the substrate surface.

24. The method of claim 22 having the further step of: providing selection of several different toning produced visible image colors; repeating the necessitous steps for producing the visible image on the electrophotographic medium for each effectively separate toned image color; and, producing overlay transfer of each of the separate successive color toned images thereby producing a multicolor image on the receiving substrate.

25. The method of claim 24 having the further step of: cleaning any residual toning substance from the electrophotographic medium surface effectively subsequent to each transfer of the image from the medium to the substrate.

26. The method of claim 22 having the further step of: registering the light borne image relative with the electrophotographic medium in a way being substantially independent from variations of the linear path; and, subsequently registering the image receiving substrate with the electrophotographic medium in a way being substantially independent from variations of the linear path.

27. A method of producing a print copy of a graphic arts image from a transparency carrying said image using an apparatus which includes a support framework, a movable platen assembly mounting an electrophotographic member having a photoconductive surface, an imaging station having a copyboard adapted to have a transparency mounted thereon and capable of transmitting radiant energy through said transparency, a charging station, a toning station having movable upwardly facing toning means, and an image transfer station provided with a transfer roller, said method comprising:

i. facing the platen downward and the copyboard upward, ii. starting at a home station and moving the platen assembly in a linear path to the charging station and there applying a uniform charge to the photoconductive surface from below the said surface, iii. moving said platen assembly in said same linear path to the imaging station at which the platen assembly is disposed over said copyboard and raising the copyboard to engage the charged photoconductive surface carried by the electrophotographic member mounted to the platen assembly, drawing a vacuum between said photoconductive surface and said copyboard for effecting an intimate engagement of said surface and transparency, iv. illuminating the platen through the copyboard and through any transparency which may be carried by said copyboard, v. lowering the copyboard to free the platen assembly, vi. moving said toning means upward to a location where said toning means lie in the linear path and moving the platen assembly in the linear path to be intercepted by said toning means thereby to displace said toning means from said linear path whereby to establish a precise toning gap between the photoconductive surface and said toning means as said platen assembly passes through said toning station, vii. continuing the movement of said platen assembly to said image transfer station and stopping the platen assembly at said image transfer station with the photoconductive surface facing downward, viii. simultaneously bringing a transfer medium against said photoconductive surface while said carriage is at said transfer station while moving the transfer roller in a first direction against said photoconductive surface, the transfer medium being sandwiched between the transfer roller and the photoconductive surface, ix. moving the transfer roller in a second direction opposite the first direction and releasing the transfer medium from the photoconductive surface, x. returning said platen assembly along the linear path to the home station and the additional step of xi. effecting registration between the electrophotographic member and the transparency at the imaging station and between the electrophotographic member and the transfer medium at the transfer station whereby to render the functional operational relationship of said elements at said stations independent of the disposition of said stations relative to the framework.

28. The method as claimed in claim 27 and the step of applying an electrically insulating liquid to the transfer medium prior to moving the transfer roller thereacross in the first direction.

29. The method as claimed in claim 28 in which the step of applying the electrically insulating liquid is performed by mounting the transfer medium depending freely within the interior of the housing at the transfer station and spraying the insulating liquid onto said transfer medium while the transfer medium is so mounted and prior to translation of the transfer roller for effecting transfer of the toned image.

30. The method as claimed in claim 27 and the step of wetting the transfer medium before translation of the transfer roller in the first direction.

31. The method as claimed in claim 27 and the step of generating a negative bias voltage and coupling said bias voltage to the transfer roller during the translation of said transfer roller while the transfer medium is engaged with the toned photoconductive surface.

32. The method as claimed in claim 27 and the step of moving the platen assembly at least twice over the charging device for applying the charge potential to the photoconductive surface.

33. The method as claimed in claim 27 and flowing toning liquid continuously across the toning means.

34. The method as claimed in claim 27 and repeating the steps of charging, imaging, toning and transfer but removing and replacing the transparency with another color separated transparency before each new series of steps and elevating a different one of plural substantially identical toning means just prior to effecting each toning step, each one of said toning means carrying a different toning liquid.

35. The method as claimed in claim 27 and the step of discharging the photoconductive surface of said electrophotographic member subsequent to transfer and prior to its return to the home position.

36. The method as claimed in claim 27 and the step of applying a reverse polarity current to the corona charging device as the platen assembly passes thereover during its return translation to the home position, the polarity being opposite to the polarity of current directed to the charging device during the charging of the photoconductive surface just prior to the charging step.

37. The method as claimed in claim 27 and the steps of exposing the photoconductive surface to radiant energy during return translation thereof to the home position for discharging of said surface of any residual charge potential remaining thereon subsequent to transfer of the image therefrom.

38. The method as claimed in claim 27 wherein the home station is located at the imaging station so that the platen assembly is returned to the imaging station subsequent to transfer.

39. The method as claimed in claim 27 wherein the platen assembly is hingedly mounted and the step of loading the copyboard while the platen assembly is pivotally displaced from superposition over the copyboard and pivoting the platen assembly about its mounting to dispose same over the copyboard prior to charging and imaging.

40. The method as claimed in claim 27 and the step of applying an electrical bias voltage of selected polarity across the transfer roller and transfer medium to assist the transfer of the toned image to the transfer medium.

41. The method as claimed in claim 27 and the steps of applying a first electrical bias voltage to the transfer roller during a first translation of the transfer roller and applying a second electrical bias voltage of opposite polarity to the transfer roller during the return translation thereof.

42. The method as claimed in claim 27 wherein the steps of charging, imaging, toning and transfer are repeated but with the transparency removed and replaced with another transparency and elevating a different one of plural substantially identically constructed toning means into toning proximity for each transparency employed, each toning means containing a different toning liquid.

43. The method as claimed in claim 27 and the step of providing registration holes in the transparency and transfer medium and pin and socket means on the copyboard, platen and the transfer medium mounting means and effecting mounting in registration of the respective mounted members.

44. The method as claimed in claim 27 and the additional step of cleaning the photoconductive surface of any residual toner subsequent to completion of the transfer step.

* * * * *